US009534301B2

(12) United States Patent
Brouwer et al.

(10) Patent No.: US 9,534,301 B2
(45) Date of Patent: Jan. 3, 2017

(54) MULTI-STAGE ANTI-CORROSION TREATMENT OF METAL COMPONENTS HAVING ZINC SURFACES

(71) Applicant: HENKEL AG & CO. KGAA, Düsseldorf (DE)

(72) Inventors: Jan-Willem Brouwer, Willich (DE); Frank-Oliver Pilarek, Köln (DE); Rainer Scheffel, Düsseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 14/031,213

(22) Filed: Sep. 19, 2013

(65) Prior Publication Data

US 2014/0023882 A1 Jan. 23, 2014

Related U.S. Application Data

(63) Continuation of application No. PCT/EP2012/053907, filed on Mar. 7, 2012.

(30) Foreign Application Priority Data

Mar. 22, 2011 (EP) ..... 11159220

(51) Int. Cl.

| | |
|---|---|
| ***C23C 22/78*** | (2006.01) |
| ***C23C 22/60*** | (2006.01) |
| ***C23F 11/18*** | (2006.01) |
| ***C23C 22/12*** | (2006.01) |
| ***C23C 22/36*** | (2006.01) |
| ***C23C 22/73*** | (2006.01) |
| ***C23C 22/83*** | (2006.01) |
| *C23C 22/00* | (2006.01) |

(52) U.S. Cl.

CPC ..... *C23F 11/184* (2013.01); *C23C 22/12* (2013.01); *C23C 22/364* (2013.01); *C23C 22/60* (2013.01); *C23C 22/73* (2013.01); *C23C 22/83* (2013.01); *Y10T 428/12799* (2015.01)

(58) Field of Classification Search

CPC ..... C23C 22/12; C23C 22/182; C23C 22/60–22/67; C23C 22/78; C23C 22/80

USPC ..... 148/254

See application file for complete search history.

(56) References Cited

U.S. PATENT DOCUMENTS

| | | | | |
|---|---|---|---|---|
| 3,181,976 | A | 5/1965 | Yager | |
| 3,444,007 | A | 5/1969 | Maurer et al. | |
| 3,515,600 | A | 6/1970 | Jones et al. | |
| 3,620,949 | A | 11/1971 | Caulfield et al. | |
| 4,163,679 | A | 8/1979 | Nagae et al. | |
| 4,278,477 | A | 7/1981 | Reinhold | |
| 4,511,513 | A | 4/1985 | Guth et al. | |
| 4,801,337 | A | 1/1989 | Higgins | |
| 4,888,386 | A | 12/1989 | Huang et al. | |
| 5,294,266 | A | 3/1994 | Hauffe et al. | |
| 5,792,283 | A | 8/1998 | Roland et al. | |
| 6,090,224 | A | 7/2000 | Wichelhaus et al. | |
| 6,197,126 | B1 * | 3/2001 | Roland et al. | 148/262 |
| 6,447,662 | B1 | 9/2002 | Brouwer et al. | |
| 6,720,032 | B1 * | 4/2004 | Kuhm et al. | 427/327 |
| 7,709,435 | B2 | 5/2010 | Hino et al. | |
| 8,337,641 | B2 | 12/2012 | Yamamoto et al. | |
| 8,715,403 | B2 | 5/2014 | Brouwer et al. | |
| 9,228,088 | B2 | 1/2016 | Brouwer et al. | |
| 2004/0112471 | A1 | 6/2004 | Moriya et al. | |
| 2006/0278307 | A1 * | 12/2006 | Nitschke | C23C 22/16 148/260 |
| 2008/0302448 | A1 | 12/2008 | Frey et al. | |
| 2013/0202797 | A1 * | 8/2013 | Brouwer et al. | 427/287 |
| 2013/0202800 | A1 * | 8/2013 | Brouwer et al. | 427/327 |

FOREIGN PATENT DOCUMENTS

| | | |
|---|---|---|
| DE | 1521854 | 11/1970 |
| DE | 2317896 | 11/1973 |
| DE | 3110822 A1 | 12/1981 |
| DE | 3208311 A1 | 12/1982 |
| DE | 4017186 A1 | 12/1991 |
| DE | 4341041 A1 | 8/1995 |
| DE | 19606017 A1 | 8/1997 |

(Continued)

OTHER PUBLICATIONS

International Search Report for PCT/EP2012/053907, dated Jun. 15, 2012, 3 pages.

International Search Report for PCT/EP2011/050526, mailed Apr. 21, 2011.

DIN EN ISO 20567-1, Paints and varnishes—Determination of stone-chip resistance of coatings, Part 1: Multi-impact testing, Edition Jan. 1, 2007. Copyright ON-2007. Published by ON Osterreichisches Normunginstitut.

DIN EN ISO 2114, Copyright DIN Deutsches Institut fur Normung e.V., Germany, Jun. 2002.

VDA 621-415, Testing of Corrosion Protection of Vehicle Paint by Alternating Cycles Test. Copyright 2006, Ascott Analytical Equipment Ltd.

*Primary Examiner* — Lois Zheng

(74) *Attorney, Agent, or Firm* — Mary K. Cameron

(57) ABSTRACT

The present invention relates to the field of phosphating for corrosion-protective pretreatment of zinc surfaces, being directed toward the use of largely nickel- and cobalt-free zinc phosphating solutions. The present invention makes available an alternative to trication zinc phosphating, in which the zinc surfaces of a component are firstly, before zinc phosphating, passivated with an alkaline composition containing iron(III) ions, and thereby preconditioned for a largely nickel- and cobalt-free zinc phosphating operation. In a further aspect, the invention relates to a component, in particular an automobile body, that comprises at least in part surfaces made of zinc, the zinc surfaces being covered by a two-layer system made up of a first, inner passive layer containing iron and resting on the zinc surface, and a second, outer crystalline zinc phosphate layer resting on the inner layer.

19 Claims, No Drawings

(56) References Cited

FOREIGN PATENT DOCUMENTS

| | | | | | |
|---|---|---|---|---|---|
| DE | 19705701 | | | 8/1998 | |
| DE | 102010001686 | | * | 8/2011 | ..... C23C 22/60 |
| DE | 102010030697 | | * | 1/2012 | ..... C23C 22/36 |
| EP | 154384 | A2 | | 9/1985 | |
| EP | 0240943 | A2 | | 10/1987 | |
| EP | 0659906 | A1 | | 6/1995 | |
| EP | 1368508 | | | 12/2003 | |
| FR | 2352070 | A1 | | 12/1977 | |
| JP | 61023769 | A | | 2/1986 | |
| JP | 62020880 | A | | 1/1987 | |
| JP | 2003201575 | A | | 7/2003 | |
| JP | 2004500479 | A | | 1/2004 | |
| WO | 9507370 | A1 | | 3/1995 | |
| WO | 9630559 | A1 | | 10/1996 | |
| WO | 99/07917 | A1 | | 2/1999 | |
| WO | 0140546 | A1 | | 6/2001 | |
| WO | 2007065645 | A1 | | 6/2007 | |
| WO | 2009045845 | A2 | | 4/2009 | |

* cited by examiner

MULTI-STAGE ANTI-CORROSION TREATMENT OF METAL COMPONENTS HAVING ZINC SURFACES

This application is a continuation of PCT/EP2012/053907 filed Mar. 7, 2012, which claims priority to EP11159220.0, filed Mar. 22, 2011.

The present invention relates to the field of phosphating for corrosion-protective pretreatment of zinc surfaces, being directed toward the use of largely nickel- and cobalt-free zinc phosphating solutions. The present invention makes available an alternative to trication zinc phosphating, in which the zinc surfaces of a component are firstly, before zinc phosphating, passivated with an alkaline composition containing iron(III) ions, and thereby preconditioned for a largely nickel- and cobalt-free zinc phosphating operation. In a further aspect, the invention relates to a component, in particular an automobile body, that comprises at least in part surfaces made of zinc, the zinc surfaces being covered by a two-layer system made up of a first, inner passive layer containing iron and resting on the zinc surface, and a second, outer crystalline zinc phosphate layer resting on the inner layer.

The phosphating of metals using a zinc-containing phosphating solution has the objective of generating, on the metal surface, firmly adhering metal phosphate layers that by themselves already improve corrosion resistance and that in combination with paints and other organic coatings contribute to a substantial increase in paint adhesion and in resistance to infiltration under corrosive stress. Phosphating methods of this kind have been known for some time. The low-zinc phosphating methods, in which the phosphating solutions have comparatively low concentrations of zinc ions (e.g. from 0.5 to 2.0 g/L), are particularly suitable for pretreatment before painting. An essential parameter in these low-zinc phosphating baths is the weight ratio of phosphate ions to zinc ions, which is usually in the range >8 and can assume values of up to 30.

It has become apparent that the concurrent utilization of other polyvalent cations in the zinc phosphating baths allows phosphate layers having appreciably improved corrosion protection properties and paint adhesion properties to be implemented. For example, low-zinc methods with the addition of, for example, 0.5 to 1.5 g/L manganese ions and e.g. 0.3 to 2.0 g/L nickel ions are widely used, as so-called "trication" methods or trication zinc phosphating processes, to prepare metal surfaces for painting, for example for cathodic electrocoating of auto bodies. Trication phosphating offers the advantage that both zinc and iron or rather steel, and aluminum can be provided with an outstanding paint adhesion base with a crystalline zinc phosphate layer of comparable quality, and form an outstanding paint adhesion base for subsequently applied dipcoating paints. In layer-forming phosphating, i.e. the provision of homogeneous crystalline layer coatings of zinc phosphate on steel, galvanized steel and aluminum, trication zinc phosphating has at present no competition in terms of the quality of the coatings that is achieved.

The high concentration of nickel ions in the compositions for trication zinc phosphating, and thus of nickel and nickel compounds in the phosphate layers that are formed, nevertheless has disadvantages in that nickel and nickel compounds are regarded critically in terms of environmental protection and workplace hygiene. An increasing number of low-zinc phosphating methods have therefore recently been described that, without concurrent use of nickel, lead to phosphate layers of a high quality similar to that of the nickel-containing methods. It has been found, however, that the phosphating of galvanized steel or zinc using nickel-free phosphating baths generally results in insufficient corrosion protection and insufficient paint adhesion.

In the field of automobile production that is particularly relevant for the present invention, different metallic materials are to an increasing extent being used and combined into composite structures. In auto body construction what is used predominantly is still a wide variety of steels, because of their specific material properties, but also increasingly lightweight metals such as aluminum, which are particularly significant in terms of a considerable reduction in the weight of the overall body. A particular problem that often exists in the automobile industry is that nickel-free zinc phosphating methods known in the existing art cause surfaces made of zinc to compare quite badly to steel surfaces in terms of protection from corrosive infiltration of the paint layer and paint adhesion, and newer technologies such as conversion treatment, with formation of extremely thin X-ray amorphous passive layers, do not yet equal the performance of zinc phosphating on steel.

DE 19834796 and DE 19705701 disclose a method utilizing low-nickel zinc phosphating that requires targeted post-passivation with lithium, copper, or silver ions in order to achieve good corrosion protection on a metal mix of steel, galvanized steel, and aluminum.

DE 4341041 discloses a nickel-free low-zinc phosphating method that is directed toward the use of m-nitrobenzenesulfonate as an accelerator, and a comparatively low nitrate content of less than 0.5 g/L, in order to obtain good corrosion protection results on zinc surfaces as well.

DE 19606017 likewise discloses a nickel-free low-zinc phosphating method in which the phosphating solution contains copper ions in order to improve corrosion protection.

Proceeding from this existing art, the object therefore still exists of establishing a phosphating method that provides, largely independently of the metallic substrate, corrosion protection and paint adhesion that can hitherto be achieved only on iron or steel surfaces using trication zinc phosphating, where the use of heavy metals, in particular nickel, can be largely or entirely omitted.

This object is achieved by means of a multi-step treatment method for a component that comprises at least in part surfaces made of zinc or zinc alloys, where the component is firstly, in step i), brought into contact with an alkaline aqueous composition (A) that contains a) at least 50 mg/L iron(III) ions, and b) at least 100 mg/L complexing agents selected from organic compounds c1) that comprise at least one functional group selected from —COOX, —$OPO_3X$ and/or —$PO_3X$, where X represents either a hydrogen atom or an alkali-metal and/or alkaline-earth-metal atom, and/or condensed phosphates c2) calculated as $PO_4$, the composition having a free alkalinity of at least 1 point but less than 6 points, and a pH in the range from 10.5 to 14, and then in step ii), with or without an interposed rinsing step and with or without previous activation, is brought into contact with an acidic aqueous composition (B) for zinc phosphating that has a pH in the range from 2.5 to 3.6 and contains a) 0.2 to 3.0 g/L zinc(II) ions, b) 5.0 to 30 g/L phosphate ions, calculated as $P_2O_5$, and c) respectively less than 0.1 g/L, by preference respectively less than 0.01 g/L, particularly preferably respectively less than 0.001 g/L of ionic compounds of the metals nickel and cobalt, based in each case on the metallic element.

A "component that comprises at least in part surfaces made of zinc or zinc alloys" encompasses for purposes of the present invention both a semi-finished product manufactured from zinc or galvanized steel, for example galvanized steel strip, and finished products assembled from identical or different materials, for example an automobile body made of galvanized steel, steel, and aluminum.

A "zinc alloy" is understood according to the present invention as alloys having an impurity atom proportion of less than 50 at %. Hereinafter the term "zinc" encompasses both pure zinc and zinc alloys.

A "rinsing step" is understood according to the present invention as rinsing with tap water or deionized water ($\kappa<1$ $\mu Scm^{-1}$) in order to remove, from the component to be treated, water-soluble residues and particles that have been carried over from a preceding treatment step adhering to the component.

"Activation" is understood according to the present invention as an activation at least of the zinc surfaces of the component for subsequent phosphating, which assists the formation of uniform finely crystalline zinc phosphate layers. Activation, which according to the present invention is carried out immediately before step ii) but after step i), is carried out with an aqueous composition that has a pH in the range from 3.5 to 13. The presence of an activation between step i) and step ii) is preferred according to the present invention. Such activations and the activation baths associated therewith are commonly known to one skilled in the art of phosphating and are disclosed e.g. in EP 1368508.

A parameter that is crucial for the effectiveness of compositions (A) in step i) of the method according to the present invention is the free alkalinity. Free alkalinity is determined by titrating 2 ml of bath solution, preferably diluted to 50 ml, with a 0.1 n acid such as, for example, hydrochloric acid or sulfuric acid, to a pH of 8.5. The amount of acid solution (in ml) consumed indicates the number of points of free alkalinity.

The term "condensed phosphates" in accordance with component c1) in step i) of the method according to the present invention refers collectively to the metaphosphates ($Me_n[P_nO_{3n}]$), di-, tri- and polyphosphates ($Me_{n+2}[P_nO_{3n+1}]$ or $Me_n[H_2P_nO_{3n+1}]$), isometaphosphates and crosslinked polyphosphates that are water-soluble at room temperature, where Me are either alkali-metal or alkaline-earth-metal atoms. Instead of the water-soluble salts the corresponding condensed acids of phosphoric acid can of course also be used to formulate compositions (A), provided the free alkalinity is adjusted as indicated. The mass-related proportion of "condensed phosphates" in accordance with component c2) in step i) of the method according to the present invention is always calculated as a corresponding quantity of $PO_4$. Analogously, for the determination of those molar ratios that encompass a quantity of condensed phosphates, that quantity of condensed phosphates is always referred to the equivalent quantity of $PO_4$.

In the method according to the present invention it is possible to deposit optimal crystalline zinc phosphate layers onto the zinc surfaces of the component with high coverage and with outstanding adhesion to the zinc substrate, without using a conventional trication zinc phosphating system containing heavy metal ions based on nickel and/or cobalt. Thanks to the interaction of the zinc surfaces preconditioned or rather passivated in alkaline fashion in step i) with the nickel- and/or cobalt-free zinc phosphating in step ii), the zinc phosphate layer made available on the zinc surfaces of the component represent a corrosion-protecting paint adhesion base that is entirely equivalent to the paint adhesion base generated in a conventional trication zinc phosphating operation.

It has become apparent that an aqueous alkaline composition (A) in step i) of the method according to the present invention brings about suitable passivation of zinc surfaces, which affords good bonding of the subsequent zinc phosphating, in particular when the free alkalinity is less than 5 points. This also applies especially to the application of composition (A) using a spray method, which produces suitable passivation in particular when the free alkalinity is less than 4 points. It has been found, surprisingly, that large surface coverage values (above 150 $mg/m^2$) of iron on zinc surfaces prove to be rather disadvantageous for the method according to the present invention, since poorer adhesion results with regard to organic topcoats are achieved in combination with zinc phosphating, so that compositions (A) in step i) must not have an excessively high free alkalinity. The free alkalinity should, however, by preference be at least 2 points in order to generate optimal surface coverages (at least 20 $mg/m^2$) on zinc surfaces based on the element iron. Compositions (A) that exhibit a free alkalinity above 6 points yield high surface coverages of iron on the zinc surfaces, but adhesion to paint layers applied after step ii) is appreciably reduced by high surface coverages based on the element iron, so that corrosion protection is also less effective or rather insufficient.

Composition (A) in step i) of the method according to the present invention has a pH of at least 10.5. Below a pH of 10.5, surface coverages of iron of at least 20 $mg/m^2$ on zinc surfaces are not formed when the latter are brought into contact with a composition (A), so that no alkaline passivation of zinc surfaces for subsequent zinc phosphating occurs at such low pH values. In order to minimize pickling attack on the zinc surfaces of the component, it is further preferred that the pH in composition (A) in step i) of the method according to the present invention not be above 13. For the case in which the component comprises surfaces made of aluminum as well as the zinc surfaces, it is advantageous if the pH in composition (A) in step i) of the method according to the present invention does not assume values above 11.5, since otherwise the intensified pickling attack produces an intense black discoloration of the aluminum surface (so-called "Brunnenschwärze", a type of smut specific to aluminum surfaces) that has a disadvantageous effect on the effectiveness of a subsequent conversion treatment, for example on zinc phosphating in step ii) of the method according to the present invention or, in the context of zinc phosphating in step ii) that is adjusted not to form layers on aluminum, on an acidic post-passivation operation, subsequent to the method according to the present invention, based on water-soluble inorganic compounds of the elements zirconium and/or titanium.

The proportion of iron(III) ions in composition (A) in step i) of the method according to the present invention is by preference no more than 2000 mg/L. Higher proportions of iron(III) ions are unfavorable in terms of process management, since the solubility of the iron(III) ions in the alkaline medium must be maintained by means of correspondingly high proportions of complexing agents without thereby achieving more-favorable properties in terms of passivation of the zinc surfaces. Those compositions (A) in step i) of the method according to the present invention in which the proportion of iron(III) ions is at least 100 mg/L, particularly preferably at least 200 mg/L are preferred, however, on the one hand in order to ensure alkaline passivation on the zinc surfaces in step i) of the method according to the present invention within process-typical treatment times of less than two minutes, and on the other hand to obtain phosphate layers of outstanding layer quality in step ii) of the method according to the present invention.

The complexing agents in accordance with component c) of the alkaline composition (A) in step i) of the method according to the present invention are by preference contained in a quantity such that the molar ratio of all components c) to iron(III) ions is greater than 1:1 and particularly preferably is at least 2:1, especially preferably is at least 5. It is apparent that utilization of the quantity of complexing agents at a stoichiometric excess is advantageous in terms of process management, since the proportion of iron(III) ions can thereby be kept permanently in solution. Precipitation of insoluble iron hydroxides is thereby completely suppressed, so that composition (A) remains permanently stable and is not depleted of iron(III) ions. At the same time, however, sufficient deposition onto the zinc surfaces of an inorganic layer containing iron ions takes place. An excess of complexing agents thus does not suppress the precipitation and deposition of insoluble iron salts in a reaction zone directly at the zinc surface, in which alkalinity is elevated because of the pickling attack of composition (A). For reasons of cost-effectiveness and in the interest of resource-conserving utilization of the complexing agents, however, it is preferred that the molar ratio of components c) to iron(III) ions in composition (A) not exceed a value of 10.

In a preferred embodiment, composition (A) in step i) of the method according to the present invention can additionally contain at least 100 mg/L phosphate ions. The result of this proportion of phosphate ions is that besides the iron ions, phosphate ions also represent a substantial constituent of the passivation layer generated in step i) on the zinc surfaces. It has been found that passive layers of this kind are advantageous for subsequent zinc phosphating, and in interaction with the zinc phosphating provide good adhesion to subsequently applied paint layers. It is accordingly further preferred in step i) of the method according to the present invention that compositions (A) contain at least 200 mg/L, particularly preferably at least 500 mg/L phosphate ions. The properties of the passive layer that forms when the zinc surface of the component is brought into contact with compositions (A) in step i) of the method according to the present invention are not influenced in additionally positive fashion above a proportion of 4 g/L phosphate ions, so that for reasons of cost-effectiveness the proportion of phosphate ions in composition (A) in step i) of the method according to the present invention should by preference be below 10 g/L.

The ratio of iron(III) ions to phosphate ions can be varied over a wide range. The mass-based ratio of iron(III) ions to phosphate ions in a composition (A) in step i) of the method according to the present invention is by preference in a range from 1:20 to 1:2, particularly preferably in a range from 1:10 to 1:3. Compositions (A) that exhibit such a mass ratio of components a) and b) yield, after they are brought into contact with a zinc surface, homogeneous grey-black passive layers containing phosphate ions with surface coverages from 20 to 150 mg/m$^2$ based on the element iron.

Condensed phosphates are capable of keeping iron(III) ions in solution in an alkaline medium by complexing. Although no particular limitations exist on the type of condensed phosphates in terms of their usability for compositions (A) in step i) of the method according to the present invention, those condensed phosphates that are selected from pyrophosphates, tripolyphosphates and/or polyphosphates, particularly preferably from pyrophosphates, are preferred, since they are particularly readily water-soluble and very easily accessible.

Preferred organic compounds c1) that are contained alongside or alternatively to the condensed phosphates as complexing agents in composition (A) in step i) of the method according to the present invention are those compounds that in their acid form (X=hydrogen atom) have an acid number of at least 250. Lower acid numbers impart surface-active properties to the organic compounds, so that organic compounds c1) having acid numbers below 250 can act as strongly emulsifying anionic surfactants. It is further preferred in this connection that the organic compounds not have a high molecular weight and that they not exceed a number-average molecular weight of 5000 u, particularly preferably 1000 u. If the preferred acid number, and optionally the preferred molecular weight, are exceeded, the emulsifying effect of organic compounds c1) can be sufficiently pronounced that contaminants in the form of oils and drawing grease, carried over out of the cleaning step via the component, can be removed from the alkaline passivation step only by means of laborious separation processes, for example by an addition of cationic surfactants, so that further process parameters need to be controlled. It is therefore more advantageous to adjust the alkaline passivation step, and thus composition (A) in step i) of the method according to the present invention, to be only slightly emulsifying, in order to enable conventional removal of the floating oils and greases. Anionic surfactants moreover tend toward pronounced foaming, which is particularly disadvantageous e.g. in the context of spray application of composition (A). Organic complexing agents c1) having acid numbers of at least 250 are therefore preferably used in step i) of the method according to the present invention, where the acid number indicates the quantity (in milligrams) of potassium hydroxide required per DIN EN ISO 2114 to neutralize 1 g of organic compound c1) in 100 g of water.

Preferred organic complexing agents c1) in composition (A) in step i) of the method according to the present invention are selected from α-, β and/or γ-hydroxycarboxylic acids, hydroxyethane-1,1-diphosphonic acid, [(2-hydroxyethyl)(phosphonomethyl)amino]methylphosphonic acid, diethylenetriaminepentakis(methylenephosphonic acid) and/or amino-tris-(methylenephosphonic acid) as well as salts thereof, particularly preferably hydroxyethane-1,1-diphosphonic acid, [(2-hydroxyethyl)(phosphonomethyl)amino]methylphosphonic acid, diethylenetriaminepentakis(methylenephosphonic acid) and/or amino-tris-(methylenephosphonic acid) as well as salts thereof.

The present invention thus explicitly encompasses those compositions (A) in step i) of the method according to the present invention that contain exclusively condensed phosphates c2), exclusively organic complexing agents c1), or a mixture of both. The proportion of organic complexing agent c1) in composition (A) can, however, be reduced to the extent to which complexing agent c2), selected from condensed phosphates, is contained. In a particular embodiment of the method according to the present invention, composition (A) in step i) contains both complexing agents c2) selected from condensed phosphates as well as organic complexing agents c1), the molar ratio of all components c) to iron(III) irons being greater than 1:1 but the molar ratio of components c1) to iron(III) ions being less than 1:1, particularly preferably less than 3:4, but by preference being at least 1:5. A mixture of the two complexing agents c1) and c2) is advantageous because the condensed phosphates are in equilibrium with the phosphate ions of composition (A) in the alkaline medium at elevated temperature, so that phosphate ions consumed by layer formation on the zinc surfaces are slowly made up from the condensed phosphates. Conversely, however, the presence of condensed phosphates alone is not sufficient to produce on the zinc surfaces an alkaline passivation layer containing iron and phosphate, so that the proportion of phosphate ions in composition (A) in step i) of the method according to the present invention is obligatory. In the presence of the condensed phosphates, however, the precipitation especially of poorly soluble phosphates, for example iron phosphates, is suppressed even at high pH values (above 10.5) by interaction with the organic complexing agents c2), so that compositions (A) that contain a mixture of the complexing agents are preferred in step i) of the method according to the present invention; care should preferably be taken that the molar ratio of components c1) to iron(III) ions is equal to at least 1:5.

In order to enhance cleaning capability for the metal surfaces to be treated, composition (A) in step i) of the method according to the present invention can additionally contain nonionic surfactants. This additional cleaning and activation of the metal surfaces by means of compositions (A) containing nonionic surfactants produces the advantage that passive-layer formation on the zinc surfaces occurs more homogeneously as compared with compositions (A) that do not contain nonionic surfactants as surface-active substances. Passivation formed homogeneously on the zinc surfaces of the component is a basic prerequisite for similarly homogeneous formation of the zinc phosphate layer in step ii) of the method according to the present invention. The nonionic surfactants are preferably selected from one or more ethoxylated and/or propoxylated C10 to C18 fatty alcohols having in total at least two but no more than 12 alkoxy groups, particularly preferably ethoxy and/or propoxy groups, which can be present in part end-capped with an alkyl residue, particularly preferably with a methyl, ethyl, propyl, butyl residue. For sufficient cleaning and activation of the metal surfaces in step i) of the method according to the present invention, the proportion of nonionic surfactants in a composition (A) is by preference at least 10 mg/L, particularly preferably at least 100 mg/L; for reasons of cost-effectiveness, by preference no more than 10 g/L of nonionic surfactants are contained. The use of highly emulsifying anionic surfactants in composition (A) according to the present invention should be avoided for the reasons already explained earlier, so that their concentration in compositions (A) is by preference no greater than 500 mg/L, particularly preferably no greater than 100 mg/L.

A further advantage of alkaline passivation using compositions (A) in step i) of the method according to the present invention is the fact that additions of heavy-metal ions, which are used in conventional alkaline compositions for the passivation of zinc surfaces, can be entirely omitted, so that composition (A) by preference contains no heavy metals selected from nickel, cobalt, manganese, molybdenum, chromium, and/or cerium. The presence of small quantities of these heavy metals in composition (A) that is used in a passivation step in the context of operation of a pretreatment line cannot, however, be entirely avoided. For example, nickel and manganese are usual alloy constituents of steel which, in the context of treatment with composition (A) in step i) of the method according to the present invention, can make their way into the passivation step by partial dissolution of natural oxide layers. Composition (A) in step i) of the method according to the present invention therefore by preference contains less than a total of 10 mg/L of ionic compounds of the metals nickel, cobalt, manganese, molybdenum, chromium, and/or cerium, in particular less than 1 mg/L respectively of ionic compounds of the metals nickel and cobalt, based in each case on the metallic element.

Pickling of the zinc surfaces of the metallic component during alkaline passivation in step i) of the method according to the present invention causes zinc ions to travel into the aqueous composition (A). The same also applies to aluminum ions, if the metallic components being treated also comprise surfaces made of aluminum alongside the zinc surfaces. Metal cations of the elements zinc and aluminum do not, however, exert any negative influence on the effectiveness of compositions (A) and are therefore tolerable.

In a particular embodiment of the method according to the present invention, composition (A) in step i) contains a) 0.05 to 2 mg/L iron(III) ions, b) 0.1 to 4 mg/L phosphate ions, c) at least 0.1 g/L of complexing agents selected from organic compounds c1) that comprise at least one functional group selected from —COOX, —$OPO_3X$, and/or —$PO_3X$, where X represents either a hydrogen atom or an alkali-metal and/or alkaline-earth-metal atom, and/or condensed phosphates c2) calculated as $PO_4$, d) in total 0.01 to 10 g/L of nonionic surfactants which by preference are selected from one or more ethoxylated and/or propoxylated C10 to C18 fatty alcohols having in total at least two but no more than 12 alkoxy groups, particularly preferably ethoxy and/or propoxy groups, which are present in part end-capped with an alkyl residue, particularly preferably with a methyl, ethyl, propyl, butyl residue, e) in total less than 10 mg/L of ionic compounds of the metals nickel, cobalt, manganese, molybdenum, chromium, and/or cerium, in particular less than 1 mg/L of ionic compounds of the metals nickel and cobalt, based in each case on the metallic element, where no more than 10 g/L of condensed phosphates c2) calculated as $PO_4$ are contained, and the molar ratio of the sum of components c1) and c2) to iron(III) ions is greater than 1:1, and where the free alkalinity is at least 1 point but less than 6 points, and the pH is at least 10.5.

Encompassed in particular in step i) of the method according to the present invention are those compositions (A) that have the following composition:

a) 0.05 to 2 g/L iron(III) ions, b) 0.1 to 4 g/L phosphate ions, c) at least 0.1 g/L of complexing agents selected from organic compounds c1) that comprise at least one functional group selected from —COOX, —$OPO_3X$, and/or —$PO_3X$, where X represents either a hydrogen atom or an alkali-metal and/or alkaline-earth-metal atom, and/or condensed phosphates c2) calculated as $PO_4$, d) in total 0.01 to 10 g/L of nonionic surfactants which by preference are selected from one or more ethoxylated and/or propoxylated C10 to C18 fatty alcohols having in total at least two but no more than 12 alkoxy groups, particularly preferably ethoxy and/or propoxy groups, which are present in part end-capped with an alkyl residue, particularly preferably with a methyl, ethyl, propyl, butyl residue, e) in total less than 10 mg/L of ionic compounds of the metals nickel, cobalt, manganese, molybdenum, chromium, and/or cerium, in particular less than 1 mg/L respectively of ionic compounds of the metals nickel and cobalt, based in each case on the metallic element, f) in total less than 0.1 g/L, by preference less than 0.01 g/L, of organic polymeric constituents that are not organic compounds c1) and by preference have a number-average molecular weight of more than 1000 u, particularly preferably more than 5000 u, g) quantities of counter ions equivalent to components a), b), and e), h) a water-soluble alkali or alkaline-earth hydroxide or ammonia, to adjust the alkalinity, i) remainder: water having a hardness of no more than 30° German hardness, where no more than 10 g/L of condensed phosphates c2) calculated as $PO_4$ is contained, and the molar ratio of the sum of components c1) and c2) to iron(III) ions is greater than 1:1, and where the free alkalinity is at least 1 point but less than 6 points, and the pH is at least 10.5.

In a preferred embodiment of the method according to the present invention, the component is brought into contact in step i) for at least 30 seconds but not more than 4 minutes, at a temperature of at least 30° C., particularly preferably at least 40° C. but no more than 70° C., particularly preferably no more than 60° C., with the alkaline aqueous composition (A). As already discussed, compositions (A) bring about a passivation of the zinc surfaces of the component which enables the growth of a crystalline, homogeneous and well-adhering zinc phosphate layer. Formation of the passive layer occurs here in self-limiting fashion, i.e. certain maximum surface coverages can be implemented depending on the specific formulation of composition (A). The preferred treatment times or rather contact times in step i) of the method according to the present invention should be selected so that the surface coverage of iron is at least 20 $mg/m^2$. The treatment and contact times for implementing a minimum surface coverage of this kind vary depending on the manner of application, and depend in particular on the flow of aqueous fluid acting on the metal surface to be treated. For example, formation of the passivation system occurs more quickly in methods in which the composition is applied by spraying than in dip applications. Regardless of the manner of application, surface coverages of iron appreciably above 250 $mg/m^2$ are not achieved with compositions (A) because the passive layer buildup is self-limiting.

For sufficient passive-layer formation and optimum preconditioning of the zinc surfaces for subsequent zinc phosphating in step ii), the result of bringing compositions (A) in step i) into contact with the component that comprises at least in part surfaces of zinc should be that surface coverages of iron of at least 20 $mg/m^2$ but by preference no more than 150 $mg/m^2$ are implemented immediately after alkaline passivation with or without a subsequent rinsing step. A deterioration of the adhesion-promoting properties of the phosphate layers deposited in step ii) onto the zinc surfaces can already occur above a surface coverage of 150 $mg/m^2$ (based on the element iron) applied in step i) of the method according to the present invention on the zinc surfaces of the component.

The method according to the present invention is of technical importance in particular in the pretreatment of automobile bodies, since alkaline passivation in step i) of the method according to the present invention can follow alkaline cleaning of the body immediately, i.e. without an interposed rinsing step. If composition (A) in step i) of the method according to the present invention, in a preferred embodiment, additionally contains nonionic surfactants, alkaline cleaning of the component or rather body and alkaline passivation of the zinc surfaces can then occur in one step. Separation of the alkaline cleaning step and alkaline passivation step by a rinsing step is thus unnecessary, as is the execution of cleaning and alkaline passivation in two method steps and different baths.

A method according to the present invention is accordingly notable in particular at least for the fact that the component that comprises at least in part surfaces of zinc is firstly brought into contact with an alkaline cleaner in a cleaning and degreasing bath, the alkaline cleaner having by preference a pH in the range from 9 to 14, with no rinsing step occurring before it is subsequently brought into contact with the alkaline aqueous composition (A) in step i).

In the method according to the present invention, as has already been discussed, in step i) an inorganic passivation layer containing iron is generated on the zinc surfaces, while no deposition of an inorganic layer of this kind on the other metallic surfaces of the component, which can be e.g. surfaces of iron, steel, and/or aluminum, could be detected. The specific deposition of the passive layer on the zinc surfaces results, surprisingly, in an appreciable improvement in the deposition of a crystalline zinc phosphate layer that occurs in step ii) of the method according to the present invention, for which no water-soluble nickel salts and/or cobalt salts need to be added to composition (B) for zinc phosphating. The method according to the present invention hence replaces trication zinc phosphating which is usual in the automobile industry, containing significant quantities of the heavy metals nickel and/or cobalt.

Composition (B) for zinc phosphating in step ii) of the method according to the present invention by preference has absolutely no ionic compounds of nickel and cobalt added to it. It cannot be excluded in practice, however, that traces of such constituents may be carried into the phosphating baths via the material to be treated, the formulation water, or the ambient air. In particular, it cannot be excluded that nickel ions may be carried into the phosphating solution in the context of the phosphating of components that comprise surfaces of steel coated with zinc-nickel alloys. It can be expected of the method according to the present invention, however, that under industrial conditions the quantity of ionic compounds of the metals nickel and cobalt in compositions (B) for zinc phosphating is by preference respectively less than 10 mg/L, particularly preferably respectively less than 1 mg/L, based in each case on the metallic element.

For the phosphating of zinc surfaces of the component in step ii) it is not absolutely necessary that composition (B) contain so-called accelerators. If components that additionally comprise steel or iron surfaces are being treated, however, it is then nevertheless necessary, for sufficient zinc phosphating thereof in step ii), that composition (B) contain one or more accelerators. Such accelerators are common in the existing art as components of zinc phosphating baths. They are to be understood as substances that chemically bond to the hydrogen resulting from pickling attack of the acid on the metal surface by the fact that they themselves are reduced.

Composition (B) in step ii) of the method according to the present invention can contain as accelerators, for example, at least one of the following quantities of accelerators recited below:

| | |
|---|---|
| 0.1 to 15 g/L | nitrate ions, |
| 0.3 to 4 g/L | chlorate ions, |
| 0.01 to 0.2 g/L | nitrite ions, |
| 0.05 to 4 g/L | nitroguanidine, |
| 0.05 to 4 g/L | N-methylmorpholine-N oxide, |
| 0.2 to 2 g/L | m-nitrobenzenesulfonate ions |

-continued

| | |
|---|---|
| 0.05 to 2 g/L | m-nitrobenzoate ions, |
| 0.05 to 2 g/L | p-nitrophenol, |
| 1 to 150 mg/L | hydrogen peroxide in free or bound form, |
| 0.1 to 10 g/L | hydroxylamine in free or bound form, |
| 0.1 to 10 g/L | of a reducing sugar. |

By preference, at least nitrate ions are contained in composition (B) as an accelerator, in a quantity of no more than 2 g/L.

Composition (B) in step ii) of the method according to the present invention contains by preference one or more further metal ions, whose positive effect on the corrosion protection of zinc phosphate layers is known in the existing art. Composition (B) can contain one or more of the following cations in the quantities indicated:

| | |
|---|---|
| 0.001 to 4 g/L | manganese(II), |
| 0.2 to 2.5 g/L | magnesium(II), |
| 0.2 to 2.5 g/L | calcium(II), |
| 0.01 to 0.5 g/L | iron(II), |
| 0.2 to 1.5 g/L | lithium(I), |
| 0.02 to 0.8 g/L | tungsten(VI). |

The present of manganese is particularly preferred in this context. The possible presence of divalent iron depends on the accelerator system described above. The presence of iron(II) in the aforesaid concentration range requires an accelerator that does not act in oxidizing fashion with respect to these ions. Hydroxylamine is to be recited in particular as an example of this.

Particularly good zinc phosphate layers are obtained with compositions (B) that additionally contain manganese(II). The manganese content of composition (B) is by preference between 0.2 and 4 g/L, since with lower manganese contents the positive influence on the corrosion behavior of the phosphate layers no longer exists, and with higher manganese contents no further positive effect occurs. Contents between 0.3 and 2 g/L and in particular 0.5 and 1.5 g/L in composition (B) in step ii) of the method according to the present invention are particularly preferred.

The zinc content of composition (B) in step ii) of the method according to the present invention is adjusted by preference to values between 0.45 and 2 g/L. As a result of pickling removal while the component is being brought into contact with composition (B) in step ii) of the method according to the present invention, however, it is possible for the actual zinc content of composition (B) to rise to up to 3 g/L. The form in which the zinc and manganese ions are introduced into composition (B) is immaterial in principle. It is particularly suitable to use the oxides and/or carbonates as a source of zinc and/or manganese.

In a preferred embodiment, compositions (B) in step ii) of the method according to the present invention additionally contain copper(II) ions in the range from 1 to 30 mg/L when the component to be treated according to the present invention also contains surfaces of iron or rather steel besides the surfaces of zinc, in order to promote in step ii) the formation of particularly advantageous zinc phosphate layers on the surfaces of iron or rather steel. If the component to be treated according to the present invention is not assembled from surfaces of iron or rather steel, however, the addition of copper(II) ions in step ii) can then be omitted, since such addition does not positively influence the properties of the zinc phosphate layer on the other metal surfaces. In this case it is preferred conversely that composition (B) in step ii) of the method according to the present invention contain less than 0.01 g/L, particularly preferably less than 0.001 g/L copper(II) ions. It is preferable in particular not to deliberately add any copper(II) ions to composition (B), although small quantities of copper(II) ions can make their way into composition (B) due to the pickling action of composition (B) when treating components that, besides the zinc surfaces, also comprise surfaces of copper-alloyed aluminum.

The weight ratio of phosphate ions to zinc ions in composition (B) in step ii) of the method according to the present invention can fluctuate within broad limits, and is by preference in the range between 3.7 and 30, particularly preferably in the range between 8 and 20. For this calculation the entire phosphorus content of composition (B) is considered to be present in the form of phosphate ions $PO_4^{3-}$. The calculation of the quantitative ratio therefore ignores the known fact that at the pH values of composition (B) for zinc phosphating, only a very small portion of the phosphate is actually present in the form of anions having a triple negative charge. It is instead to be expected at these pH values that the phosphate is present chiefly as a dihydrogen phosphate anion having a single negative charge, together with small quantities of undissociated phosphoric acid and doubly negatively charged hydrogen phosphate anions.

A further important parameter for composition (B) is its free acid content and total acid content. Free acid and total acid constitute an important regulating parameter for phosphating baths, since they represent an indicator of the pickling attack of the acid and the buffer capacity of the treatment solution, and have a correspondingly large influence on the achievable coating weight. The term "free acid" is familiar to one skilled in the art of phosphating. The determination method specific to this invention for identifying the free acid content and total acid content in a composition (B) is indicated in the Examples section.

For the underlying invention, composition (B) in step ii) possesses a free acid content, graduated in each case in accordance with an increasing preference, of at least 0; 0.2; 0.4; 0.6; 0.8; 1 point, but no more than 3; 2.5; 2; 1.5 points.

The total acid content of composition (B) in step ii) of the method according to the present invention, graduated in each case in accordance with an increasing preference, is at least 20; 21; 22 points but no more than 30; 28; 26; 25; 24 points.

The pH of the aqueous treatment solution is, with increasing preference in each case, by preference no less than 2.2; 2.4; 2.6; 2.8 but also no greater than 3.6; 3.5; 3.4; 3.3; 3.2.

If the component to be treated is a composite metal structure that also comprises surfaces of iron, steel and/or aluminum besides the surfaces of zinc, and if a zinc phosphate layer is to be formed in step ii) on all metal surfaces, it is then advantageous to add to composition (B) water-soluble inorganic compounds that represent a source of fluoride ions. The addition of free and/or complexed fluoride to a composition (B) occurs preferably in quantities of up to 2.5 g/l total fluoride, of which up to 300 mg/L free fluoride. The presence of the fluoride ions increases the pickling rate on the metal surfaces, but the aluminum ions produced in that context in the treatment of components having aluminum surfaces are immediately complexed, so that inhibition of zinc phosphating on the metal surfaces of the component can be prevented.

When fluoride is absent, the aluminum content in composition (B) is not to exceed 3 mg/L. Higher Al contents are tolerated (because of the complexing) when fluoride is present, provided the concentration of the uncomplexed aluminum ions does not exceed 3 mg/L. The use of fluoride-containing compositions (B) in step ii) of the method according to the present invention is therefore advantageous if the metal surfaces of the component that are to be phosphated are made at least in part of aluminum or contain aluminum. In these cases it is favorable not to use complexed fluoride but to use only free fluoride, by preference in concentration in the range of 0.1 to 0.3 g/L. The term "free fluoride" is familiar to one skilled in the art of phosphating. The determination method specific to this invention for identifying the free fluoride content in a composition (B) is indicated in the Examples section.

In order to suppress so-called "white spot formation" in step ii) of the method according to the present invention on the zinc surfaces of the component that are to be phosphated, composition (B) for zinc phosphating can additionally contain silicon in the form of water-soluble inorganic compounds, by preference in the form of fluorine complexes of silicon, particularly preferably in the form of hexafluorosilicic acid and/or salts thereof. "White spot formation" is understood by one skilled in the art of phosphating as the phenomenon of local deposition of amorphous white zinc phosphate, in an otherwise crystalline phosphate layer, onto the treated zinc surfaces or rather onto the treated galvanized or alloy-galvanized steel surfaces. White spot formation is brought about by a locally elevated pickling rate of the substrate. Such spot defects in the phosphating can be starting points for corrosive delamination of subsequently applied organic paint systems, so that the occurrence of spots must largely be avoided in practice. The optional addition of water-soluble inorganic compounds of silicon to a composition (B) in step ii) of the method according to the present invention brings about suppression of white spot formation upon subsequent coating of the metal surfaces, for which reason by preference at least 0.025 g/L of these compounds, calculated as $SiF_6$, should be contained in composition (B), and for reasons of cost-effectiveness of the method by preference no more than 1.5 g/L, particularly preferably no more than 1.0 g/L is contained.

In the practice of corrosion-protective treatment it has become usual, in order to reduce phosphate sludges, to selectively phosphate components that represent composite metal structures and as such also comprise at least in part surfaces of aluminum besides the surfaces of zinc and optionally iron or rather steel. "Selective phosphating" is understood according to the present invention to mean that crystalline zinc phosphate layers having a coating weight of at least 0.5 $g/m^2$, by preference at least 1 $g/m^2$, but by preference no more than 3.5 $g/m^2$, are deposited onto the surfaces of zinc and optionally of iron or rather steel, while no phosphate layers are formed on the surfaces of aluminum. The requirement that, in this preferred embodiment of the method according to the present invention, no zinc phosphate layer must form on the aluminum surfaces of the component in step ii), is to be understood to mean that no continuous and sealed crystalline layer is produced thereon, characterized in that the mass per unit area of zinc phosphate deposited onto the aluminum parts must be no more than 0.5 $g/m^2$.

According to the present invention, the surface coverage of zinc phosphate is determined, for all metal surfaces of the component, on test panels or test parts of the individual metallic materials of the component of composite design. Steel parts or galvanized or alloy-galvanized steel parts of the component are brought into contact immediately after step ii) of the method according to the present invention, for 15 minutes, with an aqueous 5-wt % $CrO_3$ solution at a temperature of 70° C., which removes the zinc phosphate layer from them. Aluminum panels, on the other hand, are brought into contact immediately after a step ii), for 15 minutes, with an aqueous 65-wt % $HNO_3$ solution at a temperature of 25° C., correspondingly removing the zinc phosphate portions from them.

The quantities of phosphorus per unit pickled area, determined in the respective pickling solutions by means of atomic emission spectroscopy measurements (ICP-OES), multiplied by a factor of 6.23, yield the respective coating weight of zinc phosphate in accordance with the present invention.

For selective phosphating of a component that encompasses surfaces both of zinc and of aluminum, the component is to be brought into contact in step ii), according to the aforementioned preferred embodiment of the method according to the present invention, with a composition (B) for zinc phosphating that has a temperature in the range from 20 to 65° C. and contains a quantity of free fluoride (measured in g/L) that is no greater than the quotient of the number 8 and the solution temperature in ° C. (8/T). Above the free fluoride concentration indicated, crystalline zinc phosphate layers are also generated on the aluminum surfaces of the component in step ii).

If composition (B) in step ii) additionally contains silicon in the form of water-soluble inorganic compounds in order to avoid white spot formation on the zinc surfaces of the component, it is then preferred, for selective zinc phosphating of the component made of zinc and aluminum, that composition (B) contain at least 0.025 g/L but less than 1 g/L silicon in the form of water-soluble inorganic compounds, calculated as $SiF_6$; and that the product (Si/mM)·(F/mM)—the concentration of silicon [Si in mM] in the form of water-soluble inorganic compounds and the concentration of free fluoride [F in mM]—divided by the points of free acid is no greater than 5, where the points of free acid in composition (B) in step ii) of the method according to the present invention is at least 0.4 points, by preference at least 0.6 points, particularly preferably at least 1.0 points, but does not exceed a value of 3.0 points, by preference 2.0 points. In this case the formation of zinc phosphate crystal clusters on the aluminum surfaces of the component in step ii) is almost completely suppressed, so that metallically lustrous aluminum surfaces result after step ii); in a conversion treatment of the component subsequent to the method according to the present invention, these can be passivated very effectively, for example, with acidic aqueous compositions containing water-soluble compounds of zirconium and/or titanium, forming a good paint adhesion base.

The upper limit that exists according to this preferred embodiment for the concentration of water-soluble inorganic compounds of silicon in composition (B) in step ii) is governed on the one hand by the cost-effectiveness of the method and on the other hand by the fact that process control is made appreciably more difficult by such high concentrations of water-soluble inorganic compounds containing silicon, since the formation of zinc phosphate crystal clusters on the aluminum surfaces can be only insufficiently suppressed by an elevation of the free acid content. The crystal clusters in turn typically represent local surface defects that can be starting points for corrosive delamination of a subsequently applied dipcoating paint.

The phosphating operation in step ii) of the method according to the present invention can be accomplished by spraying, dipping, or spray-dipping. The application time or rather time during which contact exists with composition (B) is in the usual range between approximately 30 seconds and approximately 4 minutes.

The method according to the present invention can also be executed as a strip method on continuous galvanized steel strip. Contact times with the respective compositions in steps i) and ii) in the range from approximately 2 to approximately 20 seconds are usual; step ii) can also be executed as a so-called "no-rinse" application.

In the method according to the present invention, step ii) can be followed directly, with an interposed rinsing step in each case, by further treatment steps that are selected in particular from post-passivation and/or cathodic dipcoating.

It has been found, surprisingly, that the alkaline passivation layer that is applied in step i) of the method according to the present invention onto the zinc surfaces of the component remains as such despite the subsequent zinc phosphating in step ii) caused by being brought into contact with composition (B).

The present invention therefore furthermore relates to a component that comprises at least in part surfaces of zinc, in which component the surfaces of zinc comprise a layer system encompassing a first, inner passive layer resting on the zinc surface and containing iron, and a second, outer crystalline zinc phosphate layer resting on the inner layer, the coverage of the inner layer being 20 to 150 mg/m$^2$ based on the element iron, and the coverage of the outer zinc phosphate layer being 0.5 to 3.5 g/cm$^2$, obtainable in a previously described method according to the present invention.

The first, inner layer of the component according to the present invention, which is generated in step i) of the method according to the present invention, contains the element iron in oxidized form. Also preferred is a component that comprises on its zinc surface a first, inner layer that besides iron in oxidized form additionally contains phosphate ions. The first, inner layer on the zinc surfaces of the component contains phosphate ions when the component has previously, in a preferred method according to the present invention, been brought into contact in step i) with a composition (A) that additionally contains at least 100 mg/L phosphate ions.

Additionally preferred is a component according to the present invention in which the second, outer layer on the zinc surfaces of the component, which is a zinc phosphate layer, contains respectively less than 10 mg/m$^2$ nickel and cobalt.

Detection of the first, inner layer on the zinc surfaces of the component according to the present invention occurs after dissolution of the second, outer layer, which is a zinc phosphate layer, using chromic acid; the surface coverage of iron in the first, inner layer on the zinc surfaces of the component according to the present invention is determined with the aid of a UV-spectroscopic analytical method described in the Example section (see Table 1), while the chemical state of the element iron in the layer is to be determined using X-ray photoelectron spectroscopy (XPS). Detection of phosphate ions in the first, inner layer on the zinc surfaces of the component preferred according to the present invention can likewise be carried out using X-ray photoelectron spectroscopy (XPS).

The proportion of nickel or cobalt in the second, outer layer of the preferred component according to the present invention is sensed quantitatively by means of ICP-OES in the pickling solution after dissolution of the zinc phosphate layer from the zinc surfaces of the component, and is referred to the pickled area so that a formal surface coverage based on these elements can be indicated.

The component according to the present invention can comprise on its zinc surfaces further outer layers that are by preference selected from organic paints.

Particularly preferably, the component according to the present invention represents an automobile body.

EXEMPLIFYING EMBODIMENTS

Individual method steps in a dipcoating facility for corrosion-protective treatment of galvanized steel panels (HDG: Gardobond® EA; Chemetall Co.):

A. Alkaline cleaning (pH 11):

3 wt % Ridoline® 1574A (Henkel Co.); 0.4 wt % Ridosol® 1270 (Henkel Co.) containing $H_3PO_4$, $K_4P_2O_7$, sodium gluconate, sodium salt of hydroxyethane-1,1-diphosphonic acid, KOH Treatment time at 60° C.: 180 seconds.

B. Rinse with deionized water ($\kappa$<1 μS cm$^{-1}$)

C1. Alkaline passivation in accordance with composition (A):

| | |
|---|---|
| 2.80 wt % | KOH |
| 0.19 wt % | $H_3PO_4$ |
| 0.22 wt % | $K_4P_2O_7$ |
| 0.06 wt % | sodium gluconate |
| 0.10 wt % | sodium salt of hydroxyethane-1,1-diphosphonic acid |
| 0.23 wt % | $Fe(NO_3)_3 \cdot 9H_2O$ |
| Remainder | deionized water ($\kappa$ < 1 μScm$^{-1}$) |
| Free alkalinity: | 3 |
| pH: | 11 |
| Treatment time at 60° C.: | 120 seconds |

C2. Alkaline passivation in accordance with composition (A):

| | |
|---|---|
| 1.09 wt % | KOH |
| 0.19 wt % | $H_3PO_4$ |
| 0.22 wt % | $K_4P_2O_7$ |
| 0.06 wt % | sodium gluconate |
| 0.10 wt % | sodium salt of hydroxyethane-1,1-diphosphonic acid |
| 0.23 wt % | $Fe(NO_3)_3 \cdot 9H_2O$ |
| 1.30 wt % | $NaHCO_3$ |
| Remainder | deionized water ($\kappa$ < 1 μScm−1) |
| Free alkalinity: | 10 |
| pH: | 13 |
| Treatment time at 60° C.: | 120 seconds |

D. Activation:

0.1 wt % Fixodine® 50CF (Henkel Co.)

Remainder deionized water ($\kappa$<1 μScm$^{-1}$)

Treatment time at 20° C.: 60 seconds

E1. Nickel-free phosphating in accordance with composition (B):

| | |
|---|---|
| 0.13 wt % | zinc |
| 0.09 wt % | manganese |
| 0.12 wt % | nitrate |
| 1.63 wt % | phosphate |
| 0.05 wt % | N-methylmorpholine-N oxide |
| 0.02 wt % | ammonium bifluoride |
| 0.03 wt % | $H_2SiF_6$ |
| Remainder | deionized water ($\kappa$ < 1 μScm−1) |
| Free fluoride: | 40 mg/L |
| Free acid: | 1.3 points (pH 3.6) |
| Total acid: | 24 points (pH 8.5) |
| Hydrogen peroxide: | 30 mg/L |
| Treatment time at 51° C.: | 180 seconds |

E2. Nickel-free, copper-containing phosphating in accordance with composition (B):

| | |
|---|---|
| 0.13 wt % | zinc |
| 0.09 wt % | manganese |
| 0.001 wt % | copper |
| 0.12 wt % | nitrate |
| 1.63 wt % | phosphate |
| 0.05 wt % | N-methylmorpholine-N oxide |
| 0.02 wt % | ammonium bifluoride |
| 0.03 wt % | $H_2SiF_6$ |
| Remainder | deionized water (κ < 1 μScm−1) |
| Free fluoride: | 40 mg/L |
| Free acid: | 1.3 points (pH 3.6) |
| Total acid: | 24 points (pH 8.5) |
| Hydrogen peroxide: | 30 mg/L |
| Treatment time at 51° C.: | 180 seconds |

E3. Nickel-containing phosphating (trication phosphating):

| | |
|---|---|
| 0.13 wt % | zinc |
| 0.09 wt % | manganese |
| 0.09 wt % | nickel |
| 0.12 wt % | nitrate |
| 1.63 wt % | phosphate |
| 0.05 wt % | N-methylmorpholine-N oxide |
| 0.02 wt % | ammonium bifluoride |
| 0.03 wt % | $H_2SiF_6$ |
| Remainder | deionized water (κ < 1 μScm−1) |
| Free fluoride: | 40 mg/L |
| Free acid: | 1.3 points (pH 3.6) |
| Total acid: | 25 points (pH 8.5) |
| Hydrogen peroxide: | 30 mg/L |
| Treatment time at 51° C.: | 180 seconds |

E4. Nickel-containing phosphating (trication phosphating):

as E3, but 0.01 wt % nickel

E5. Nickel-containing phosphating (trication phosphating):

as E3, but 0.005 wt % nickel

E6. Acid passivation:

| | |
|---|---|
| 0.34 g/L | $H_2ZrF_6$ |
| 0.12 g/L | ammonium bifluoride |
| 39 mg/L | $Cu(NO_3)_2 \cdot 3H_2O$ |
| Remainder | deionized water (κ < 1 μScm−1) |
| pH | 4 |
| Treatment time at 30° C.: | 120 seconds |

F. Paint structure: Cathoguard® 500 (BASF Co.): layer thickness 20 to 22 μm

The points of free acid in the exemplifying baths E1 to E5 in accordance with a composition (B) are determined by diluting 10 ml of bath sample to 50 ml and titrating with 0.1 N sodium hydroxide to a pH of 3.6. The sodium hydroxide consumed (in ml) indicates the points. The total acid content is determined correspondingly by titrating to a pH of 8.5.

The free fluoride content in the exemplifying baths E1 to E3 in accordance with a composition (B) is sensed using a potentiometric electrode system (WTW Co., inoLab®, pH/ion level 3). The electrode system contains a fluoride-sensitive glass electrode (WTW, F501) and a reference electrode (WTW, R503). For two-point calibration, the two electrodes are immersed together successively into calibration solutions having concentrations of 100 mg/L and 1000 mg/L free fluoride, produced from the Titrisol® fluoride standard of the Merck company with no added buffer. The resulting measured values are correlated with the respective fluoride content (100 and 1000 respectively) and read into the instrument. The slope of the glass electrodes is then indicated on the instrument in mV per decade of the fluoride ion content in mg/L, and is typically between −55 and −60 mV. The fluoride content in mg/L is then determined directly by immersing the two electrodes into the exemplifying baths E1 to E5 at a temperature of 25° C.

Table 1 shows the influence of alkaline passivation followed by nickel-free or rather low-nickel zinc phosphating (Examples 1 to 4 and 5, 6) on adhesion of the cathodic dipcoating paint to the zinc substrate after water aging and subsequent cross cut testing. As compared therewith, nickel-free zinc phosphating that is performed based on a composition (B) with or without the addition of copper ions, but without alkaline passivation using a composition (A), yields insufficient paint adhesion on the galvanized substrate (Examples 7, 8). Low-nickel phosphating (Examples 10, 11) performed without alkaline passivation already yields poorer results in the cross cut test as compared with nickel-containing trication phosphating (Example 9), while together with alkaline passivation (Examples 5, 6) outstanding paint adhesion can again be achieved.

It can further be gathered from the table that nickel-containing trication phosphating (Example 9), as known in the existing art, produces outstanding adhesion of the paint structure to the substrate. In the method according to the present invention, adhesion that is entirely equivalent to nickel-containing trication phosphating is achieved when the surface coverage of iron after alkaline passivation is moderate, i.e. for example approx. 100 mg/m$^2$ based on the element iron (Examples 1, 3). Greater surface coverages of iron (in the range of approx. 250 mg/m$^2$), which are deposited in a method not in accordance with the invention according to Examples 2 and 4, result, together with nickel-free zinc phosphating, in poorer paint adhesion as compared with trication phosphating (Example 9).

The method according to the present invention (see Examples 1, 3, 5, and 6) likewise produces an appreciable improvement in paint adhesion on the zinc surfaces as compared with alternative treatment methods that provide, instead of phosphating, for a conversion treatment based on fluorine complexes of zirconium (Examples 12, 13).

TABLE 1

Various method sequences for corrosion-protective treatment of galvanized steel strip, and results after crosscut adhesion testing

| Example | Method sequence | Crosscut* (0-5) | Surface coverage** $ZnPO_4$ (g/m$^2$) | Surface coverage*** iron (mg/m$^2$) |
|---|---|---|---|---|
| 1 | A-C1-B-D-E1-B-E-F | 0 | 2.5 | 102 |
| 2 | A-C2-B-D-E1-B-E-F | 1-2 | 2.6 | 252 |
| 3 | A-C1-B-D-E2-B-E-F | 0 | 2.5 | 113 |
| 4 | A-C2-B-D-E2-B-E-F | 1-2 | 2.4 | 245 |
| 5 | A-C1-B-D-E4-B-E-F | 0 | 2.7 | 112 |
| 6 | A-C1-B-D-E5-B-E-F | 0 | 2.5 | 110 |
| 7 | A-B-D-E1-B-E-F | 5 | 1.7 | — |
| 8 | A-B-D-E2-B-E-F | 5 | 1.7 | — |
| 9 | A-B-D-E3-B-E-F | 0 | 3.5 | — |
| 10 | A-B-D-E4-B-E-F | 1 | 2.2 | — |
| 11 | A-B-D-E5-B-E-F | 2 | 2.1 | — |

TABLE 1-continued

Various method sequences for corrosion-protective treatment of galvanized steel strip, and results after crosscut adhesion testing

| Example | Method sequence | Crosscut* (0-5) | Surface coverage** $ZnPO_4$ ($g/m^2$) | Surface coverage*** iron ($mg/m^2$) |
|---|---|---|---|---|
| 12 | A-C1-B-E6-B-E-F | 3 | — | 114 |
| 13 | A-C2-B-E6-B-E-F | 4 | — | 260 |

*Panels aged in deionized water ($\kappa < 1\ \mu Scm^{-1}$) at 80° C. for 30 minutes; panels cooled for 30 minutes at 20° C.; crosscut adhesion testing per DIN EN ISO 2009 and panels subsequently bent 180° at the crosscut; paint adhesion evaluated per DIN EN ISO 2009 (0 = no paint adhesion; 5 = complete paint adhesion).
**Determined by dissolving off the zinc phosphate layer with aqueous 5-wt % $CrO_3$ that was brought into contact with a defined area of the galvanized panel immediately after method step E at 25° C. for 5 minutes, and determining the phosphorus content in the same pickling solution using ICP-OES. The coating weight of zinc phosphate is determined by multiplying the quantity of phosphorus per unit area by a factor of 6.23.
***Quantitative determination of the quantity of iron(III) ions by UV photometry (PhotoFlex ®, WTW company) in 300 µl sample volume of a 5-wt % nitric acid solution that was pipetted onto a defined area (1.33 $cm^2$) of the galvanized panel immediately after method step C using a measurement cell ring (Helmut Fischer company) and taken up with the same pipette after 30 seconds of exposure time at a temperature of 25° C. and transferred into the UV measurement cuvette, in which 5 ml of a 1.0% sodium thiocyanate solution had been prepared, for determination of absorption at a wavelength of 517 nm and a temperature of 25° C. Calibration was effected using a two-point method, by determining absorption values of identical volumes (300 µl) of two standard solutions of iron(III) nitrate in 5-wt % nitric acid, which were transferred into the measurement cuvette containing 5 ml of a 1.0% sodium thiocyanate solution for determination of absorption values at 25° C.

What is claimed is:

1. A method for corrosion-protective treatment of metal surfaces of a component that comprises at least in part surfaces made of zinc or zinc alloys, wherein the component is firstly, in step i), brought into contact with an alkaline aqueous composition (A) that contains a) at least 50 mg/L iron(III) ions, and b) 0.1 to 4 q/L phosphate ions c) at least 100 mg/L of components c) complexing agents selected from:

organic compounds c1) that comprise at least one functional group selected from —COOX, —$OPO_3X$, and/or —$PO_3X$, where X represents either a hydrogen atom, an alkali-metal and/or alkaline-earth-metal atom, and/or condensed phosphates c2) calculated as $PO_4$, and the alkaline aqueous composition (A) having a free alkalinity of at least 1 point but less than 6 points, and a pH in a range from 10.5 to 14, and then in step ii), with or without an interposed rinsing step and with or without previous activation, is brought into contact with an acidic aqueous composition (B) for zinc phosphating that has a pH in a range from 2.5 to 3.6 and contains a) 0.2 to 3.0 g/L zinc(II) ions, b) 5.0 to 30 g/L phosphate ions, calculated as $P_2O_5$, and c) less than 0.1 g/L each of ionic compounds of metallic elements nickel and cobalt, based in each case on amount of the metallic element;

wherein no copper and no water-soluble nickel salts are added to the acidic aqueous composition (B) for zinc phosphating.

2. The method according to claim 1, wherein composition (A) has a pH of no more than 13.

3. The method according to claim 1, wherein a mass-based ratio of iron(III) ions to phosphate ions in composition (A) is in a range from 1:20 to 1:2.

4. The method according to claim 1, wherein a molar ratio of all components c) to iron(III) ions in composition (A) is from greater than 1:1 to 5:1.

5. The method according to claim 1, wherein condensed phosphates c2) is selected from pyrophosphates, tripolyphosphates, and/or polyphosphates are contained as components c) in composition (A).

6. The method according to claim 5, wherein in addition to component c2), organic compounds c1) that in a protonated state have an acid number of at least 250 are contained in composition (A).

7. The method according to claim 4, wherein the organic compounds c1) in composition (A) are selected from one or more of a-hydroxycarboxylic acid, b-hydroxycarboxylic acid, g-hydroxycarboxylic acid, hydroxyethane-1,1-diphosphonic acid, [(2-hydroxyethyl) (phosphonomethyl)amino] methylphosphonic acid, diethylenetriaminepentakis (methylenephosphonic acid), and/or amino-tris (methylenephosphonic acid), and salts thereof, a molar ratio of components c1) to iron(III) ions being less than 1:1.

8. The method according to claim 1, wherein composition (A) contains less than a total of 10 mg/L ionic compounds of metallic elements nickel, cobalt, manganese, molybdenum, chromium, and/or cerium, based in each case on amount of the metallic element.

9. The method according to claim 1, wherein composition (B) for zinc phosphating additionally contains one or more of:

| | |
|---|---|
| 0.001 to 4 g/L | manganese(II) |
| 0.2 to 2.5 g/L | magnesium(II) |
| 0.2 to 2.5 g/L | calcium(II) |
| 0.01 to 0.5 g/L | iron(II) |
| 0.2 to 1.5 g/L | lithium(I) |
| 0.02 to 0.8 g/L | tungsten(VI). |

10. The method according to claim 1, wherein composition (B) for zinc phosphating contains less than 0.01 g/L each of the ionic compounds of the metallic elements nickel and cobalt.

11. The method according to claim 1, wherein composition (B) for zinc phosphating contains less than 0.001 g/L copper(II) ions.

12. The method according to claim 1, wherein composition (B) for zinc phosphating contains water-soluble inorganic compounds that represent a source of fluoride ions.

13. The method according to claim 12, wherein composition (B) for zinc phosphating contains silicon in the form of water-soluble inorganic compounds.

14. The method according to claim 13, wherein the component that comprises at least in part surfaces made of zinc or zinc alloys, further comprises surfaces made of aluminum, and composition (B) has a temperature in a range from 20° C. to 65° C. and comprises a quantity of free fluoride (measured in g/L) that is no greater than a quotient of the number 8 and said temperature in ° C. (8/T).

15. The method according to claim 13, wherein composition (B) contains at least 0.025 g/L, but less than 1 g/L, of said silicon calculated as $SiF_6$, and a product (Si/mM) (F/mM) of a concentration of silicon [Si in mM] in the form of water-soluble inorganic compounds and a concentration of free fluoride [F in mM] divided by points of free acid is no greater than 5, the points of free acid in composition (B) being at least 0.4 points but not exceeding a value of 3.0 points.

16. The method according to claim 14, wherein the aluminum surfaces of the component comprise, after method step ii), a zinc phosphate layer having a layer weight of less than 0.5 $g/m^2$.

17. The method according to claim 15, wherein the zinc surfaces of the component comprise, after method step ii), a crystalline zinc phosphate layer having a layer weight in a range from 0.5 to 3.5 $g/m^2$.

18. A method for corrosion-protective treatment of metal surfaces of a component that comprises at least in part surfaces made of zinc or zinc alloys, comprising steps of:

step i), first, contacting metal surfaces of a component that comprises at least in part zinc or zinc alloy surfaces, with an alkaline aqueous composition (A) comprising:

a) at least 50 mg/L iron(III) ions, and b) 0.1 to 4 g/L phosphate ions;

c) at least 100 mg/L complexing agents c) selected from:

c1) organic compounds that comprise at least one functional group selected from —COOX, —$OPO_3X$, and/or —$PO_3X$, where X represents an atom selected from a hydrogen atom, an alkali-metal atom, alkaline-earth-metal atom, and combinations thereof; and c2) condensed phosphates, calculated as $PO_4$, and combinations of said complexing agents;

the alkaline aqueous composition (A) having a free alkalinity of at least 1 point but less than 6 points, and a pH in a range from 10.5 to 14, thereby producing a first inner passive layer comprising iron deposited on the zinc or zinc alloy surfaces;

and after step i), with or without an interposed rinsing step and with or without previous activation, step ii), contacting the component having the first inner passive layer comprising iron deposited on the zinc or zinc alloy surfaces with an acidic aqueous composition (B) for zinc phosphating that has a pH in a range from 2.5 to 3.6 and comprises:

a) 0.2 to 3.0 g/L zinc(II) ions, b) 5.0 to 30 g/L phosphate ions, calculated as $P_2O_5$, and c) less than 0.1 g/L of ionic compounds of cobalt, based in each case on amount of cobalt wherein the acidic aqueous composition (B) is nickel-free and free from added copper and forms an outer layer of crystalline zinc phosphate over the inner passive layer.

19. The method according to claim 1, wherein composition (A) further comprises at least one nonionic surfactant present in an amount of from 10 mg/L to 10 g/L, the nonionic surfactant selected from the group consisting of ethoxylated $C_{10}$ to $C_{18}$ fatty alcohols having from 2 to 12 alkoxy groups, propoxylated $C_{10}$ to $C_{18}$ fatty alcohols having from 2 to 12 alkoxy groups, and mixtures thereof.

* * * * *